US005232025A

United States Patent [19]

Gysin et al.

[11] Patent Number: 5,232,025

[45] Date of Patent: Aug. 3, 1993

[54] SHAFT ROD AND HEALD FRAME FOR A LOOM

[75] Inventors: Hansjörg Gysin; Wilhelm Servis, both of Winterthur, Switzerland

[73] Assignee: Sulzer Brothers Limited, Winterthur, Switzerland

[21] Appl. No.: 848,443

[22] Filed: Mar. 9, 1992

[30] Foreign Application Priority Data

Mar. 14, 1991 [CH] Switzerland ..... 00776/91

[51] Int. Cl.[5] ..... D03C 9/06

[52] U.S. Cl. ..... 139/92; 428/902

[58] Field of Search ..... 139/91, 92; 428/116, 428/902, 284, 285

[56] References Cited

U.S. PATENT DOCUMENTS

| | | | |
|---|---|---|---|
| 4,387,742 | 6/1983 | Graf | 139/92 |
| 4,508,145 | 4/1985 | Bowen et al. | 139/92 |
| 4,777,987 | 10/1988 | Asagi | 139/91 |
| 4,790,357 | 12/1988 | Kramer | 139/91 |
| 4,901,767 | 2/1990 | Koch | 139/92 |

FOREIGN PATENT DOCUMENTS

| | | | |
|---|---|---|---|
| 0302798 | 2/1989 | European Pat. Off. . | |
| 1020521 | 2/1953 | France . | |
| 1037843 | 9/1953 | France . | |
| 62-156331 | 7/1987 | Japan | 139/91 |
| WO88/05837 | 8/1988 | PCT Int'l Appl. . | |

*Primary Examiner*—Andrew M. Falik

*Attorney, Agent, or Firm*—Townsend and Townsend Khourie and Crew

[57] ABSTRACT

A flat shaft rod of a heald frame for a loom has two half-shells (16) made of a thermoplastic, fiber-reinforced composite which forms mechanically interconnected, rigid hollow sections (15). A rigid longitudinal reinforcement (17) is disposed on the outside of the hollow section and a carrier or support rail or bar (18) is disposed on the inside, the elements (17, 18) both being mechanically rigidly connected to the half-shells. These shaft rods are rigid and heald frames made with them are of simple construction.

26 Claims, 4 Drawing Sheets

SHAFT ROD AND HEALD FRAME FOR A LOOM

BACKGROUND OF THE INVENTION

The invention relates to a shaft rod of a heald frame for a loom, the rod containing fiber composites and being flat and to a heald frame having such rods.

The heald frames and shaft rods of modern looms must be able to withstand severe mechanical stressing. They have therefore conventionally been made of metal, steel being preferred for large cloth widths while aluminium is becoming increasingly popular for high-speed looms. The shaft rods are elaborate combinations of a large number of parts and are therefore relatively costly to produce. Also, they still have relatively high inertial masses, something which is increasingly causing problems in the light of high and increasing loom speeds. Heald frames containing thermoset composite parts are known. However, their production is still excessively elaborate and costly, their construction is complex, and there are problems with them in long-term operation.

SUMMARY OF THE INVENTION

It is therefore the object of this invention to obviate these disadvantages and to provide improved shaft rods and heald frames on which the former are used. The rods are required to be of simple construction, of reduced cost and capable of being produced rapidly, to have a reduced number of parts, low masses and/or increased stiffnesses and to have long working lives.

These problems are solved according to the invention with a novel structure combined with novel composites and their arrangement to provide improved mechanical properties and considerable simplifications and cost reductions. Basically, high strength and rigidity combined with reduced weight are achieved in a very simple way by a combination of half-shell structure with carrying and very rigid reinforcements on both sides at the flat ends of the section bar—i.e., by the external longitudinal reinforcement and the internal carrier bar, the latter carrying the healds and also being rigidly incorporated mechanically in the shaft rod. The hollow section embodied by two mechanically connected half-shells is effective as a lightweight and stable spacing device between these terminal longitudinal reinforcements. To this end, the outer longitudinal reinforcement and the inner carrier bar are each rigidly connected to the half-shells mechanically. Also, the thermoplastics matrix in the composite improves the endurance limit and notch strength of the rods and frame. The half-shell hollow section construction increases flexural strength, provides substantial vibration damping and thus helps to reduce noise considerably.

In addition, the shaft rods, which are very stable mechanically and simple to produce, can be made by thermoplastic welding of the half-shells. A large-area connection between the carrier bar and the covering layer ensures a very advantageous and simple transmission of forces, the height of the connecting area being, with advantage, at least as great as the thickness of the carrier bar. Appropriate low-cost carrier bar constructions can be devised from a steel section member or a sheet steel section member. The longitudinal reinforcement can also be embodied by steel or aluminum sections or sheet steel sections. Very light and rigid constructions can be provided by UD reinforcing fibers. Light and low-cost half-shells can contain at least 50% glass fibers and ±45% glass fiber laminate. Polyphenylene sulfide ("PPS"), polyether imide ("PEI"), polyamide ("PA"), polyether sulfon ("PES"), polysulfone ("PSU"), polyurethane ("PUR") or polyethylene ("PE") are suitable matrix materials for the half-shells. Very good rigidity is achieved by flat transition zones between, on the one hand, the half-shells and, on the other hand, the longitudinal reinforcement and the carrier bar. Advantageously, their angles of inclination are at most 40°. Forces can be introduced satisfactorily into connecting zones by a bearing surface welded thermoplastically to the half-shells.

Heald frames which are stable and of very simple construction are made with identical, symmetrically arranged top and bottom shaft rods.

DESCRIPTION OF THE PREFERRED EMBODIMENTS

Figure 1:
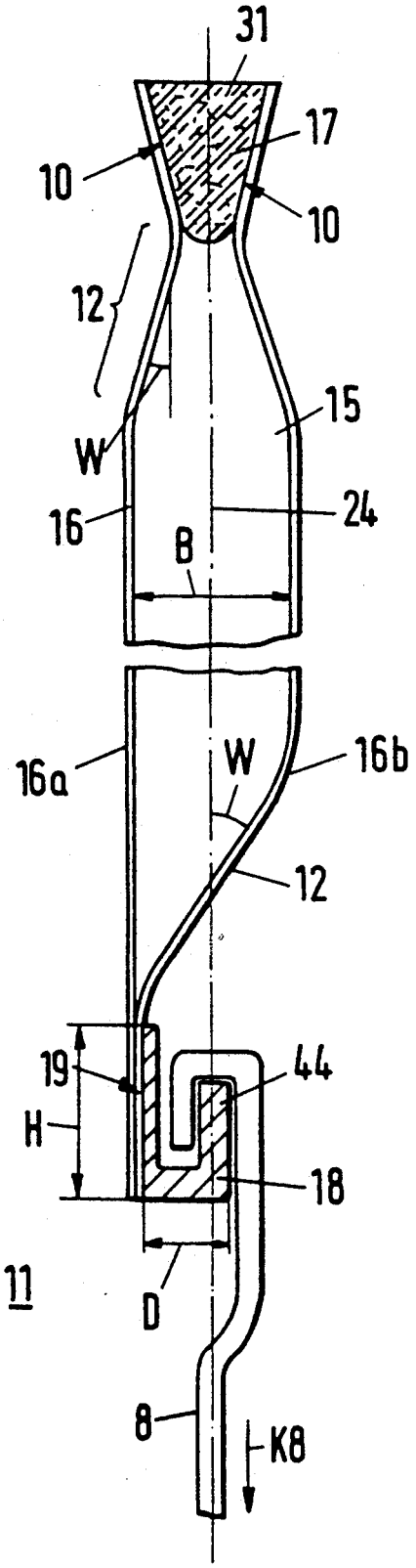
FIG. 1 is a view in section of a shaft rod according to the invention which has two half-shells and a hollow section and terminal longitudinal carriers.
Figure 8:
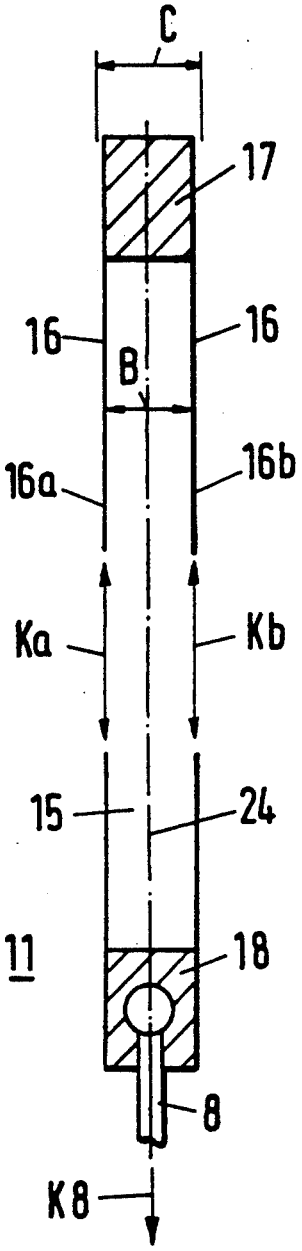
FIG. 8 shows, in section, a shaft rod constructed according to the invention.

The basic construction of a shaft rod according to the invention is schematically shown in FIG. 8 and a specific embodiment thereof is shown in FIG. 1. In contrast to conventional shaft rods a shaft rod 11 according to the invention has a simple integrated construction in which two carrying longitudinal reinforcements 17, 18 are disposed one at each end of the flat rod 11, there being provided an outer longitudinal reinforcement 17 and an inner reinforcement or carrying bar 18, the latter carrying the healds 8 and therefore receiving the heald tensions K8 (see also FIG. 9). These longitudinal carriers 17, 18 cooperate with a hollow section 15, disposed between them and defined by two half-shells 16 to form a very light carrying structure which is very strong and has considerable strength in respect of the heald tensions K8. The light and mechanically strong half-shells 16 are made of a thermoplastics composite having industrial endless fibers. They each have inside and outside surfaces defining inner and outer edge strips. The hollow section 15 is effective as a spacer which transmits or receives the forces Ka, Kb between the carriers 17 and 18. If the section 15 has a relatively large width B sufficient to occupy substantially completely the shaft pitch C i.e., the space available for a heald frame. A high flexural strength in respect of twisting moments produced by other forces is provided, so that vibrations are reduced or suppressed. There is therefore a considerable noise reduction. The construction enables the direction K8 of the heald tensions to be displaced into the center plane 24 of the rod section, so that twisting forces are reduced. The mechanically rigid connection of the longitudinal carriers 17, 18 to the half-shells 16 is of considerable importance. Very light and rigid half-shells can have, for example, a layer thickness of only 0.4 to 1 mm.

In the embodiment of FIG. 1 the longitudinal reinforcement is in the form of a unidirectional ("UD") section 31. This section, which has high specific strength and rigidity, is made of unidirectional carbon fibers or glass fibers embedded in a thermoplastic matrix. A very satisfactory connection is obtained by way of the connecting surface 10 between the longitudinal reinforcement 17 and the half-shells 16 if both latter elements have the same matrix material and are welded together thermoplastically at the connecting surface 10. Also, connections of this kind are simple and quick to make. On the inside of the section a steel section 44 serving as carrier bar 18 for the healds 8 is mechanically rigidly connected to the half-shells 16. The latter connection can be made with threaded bolts or rivets, for examples, Very advantageously, however, large-area connections are effected by bonding, welding or amorphous joining, quasi-thermoplastic soldering. The steel section 44 is formed to generate a relatively large connecting area 19. Advantageously, the height H thereof is greater than carrier bar thickness D. To simplify the suspension of the healds 8 on the bar 18 and to shift the heald forces K8 into the shaft rod center plane 24, one half-shell **16*b* is formed with a shallow bend in a transition zone 12 between the center of the shaft rod and the inside. For adaptation to the unidirectional longitudinal reinforcement 31 the half-shells 16*a*, 16*b* are also given a shallow bend in a transition zone 12**. These transition zones have relatively small angles W which are preferably at most 40°.

Figure 2:
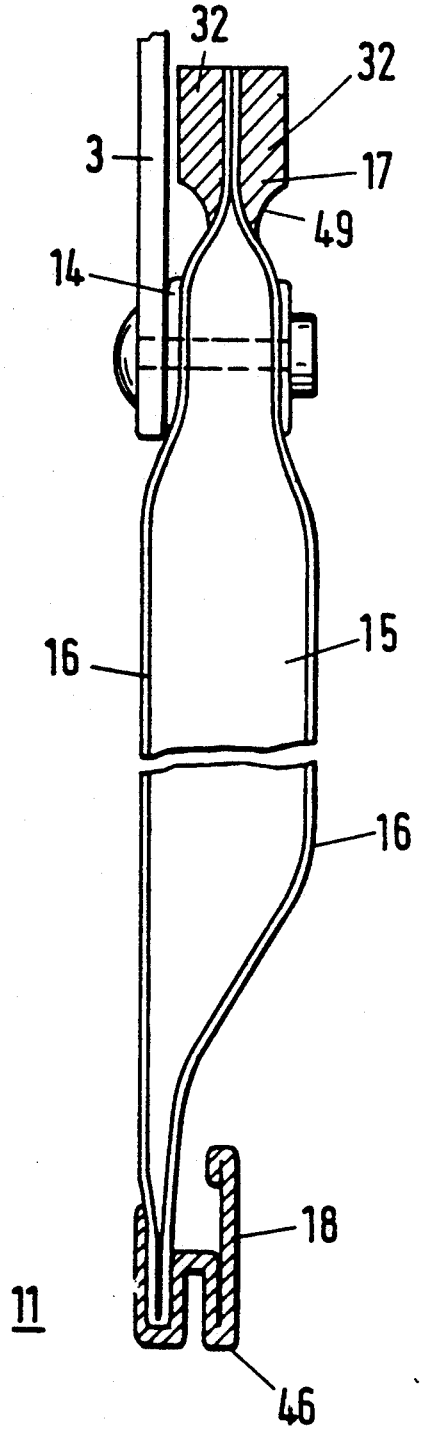
FIGS. 2 and 3 show, in section, other examples of shaft rods.
Figure 6:
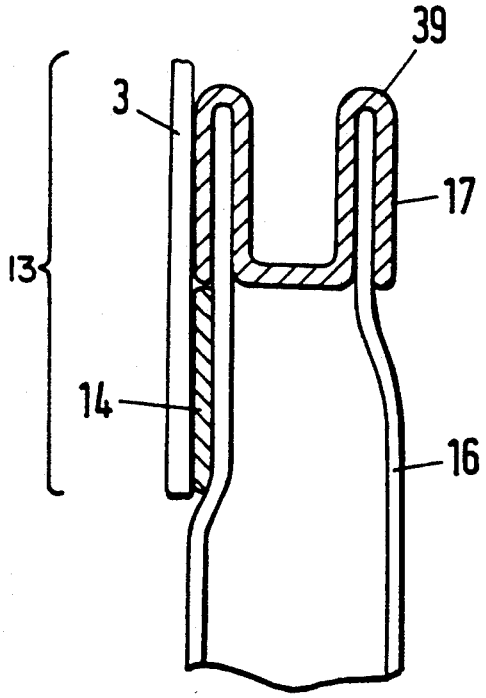

FIG. 2 shows a half-shell shaft rod having a two-part longitudinal reinforcement 17 in the form of unidirectional sections 32 and, as heald-carrying bar 18, a sheet steel section 46 which is simple to shape and inexpensive. Another advantage of the half-shell rods according to the invention is the possibility of simple production of connecting parts for connecting elements such as guide elements 4 and actuating elements 3 which ensure that forces are applied advantageously to the half-shell section. To this end, a fiber reinforced bearing surface 14 having the same thermoplastic matrix can be welded to the half-shells 16. A connection zone 13 for an actuating element 3 formed thus in this manner is shown in FIG. 6 (see also FIGS. 9 and 10). The run-out shape 49 of the unidirectional section 33 provides a continuous transmission of forces to the half-shell structure.

Figure 3:
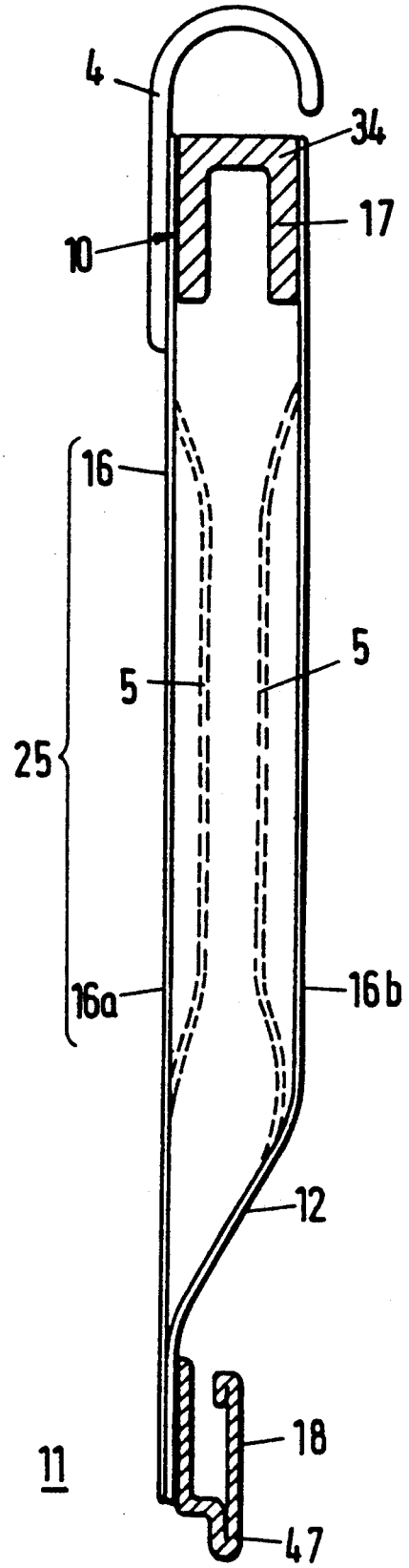

In the example shown in FIG. 3 a connection zone 5 is formed by thermoplastic reshaping and, depending upon the forces to be dealt with, with or without an additional bearing surface 14, in the central zone 25 of the rod cross-section, such zone receiving the connection to the side supports 2 of a heald frame, as will be described in greater detail with reference to FIGS. 9 and 11. In FIG. 3 the longitudinal reinforcement 17 is bonded in between the half-shells **16*a*, 16*b* as a steel section 34 and is configured to eliminate curved transition zone on the outside of the section. All that is necessary is a transition zone 12 of shallow curvature on the inside between one half-shell 16*b* and the bar 18. The bar 18 is another example of a sheet-steel section. A rod-guiding element 4 is bonded to the half-shell 16 on the outside of the rod, the steel section 34** acting in this case as a reinforcing support.

Figure 4:
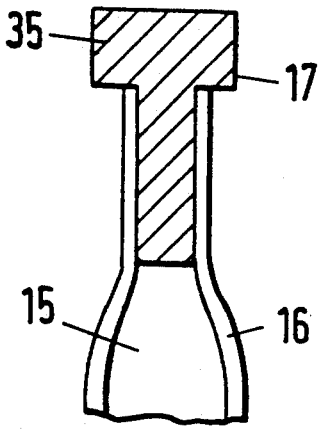
FIGS. 4 to 7 are fragmentary views, in section, of examples of longitudinal reinforcements of the shaft rod.
Figure 5:
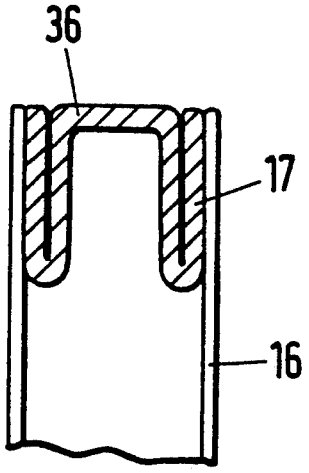
Figure 7:
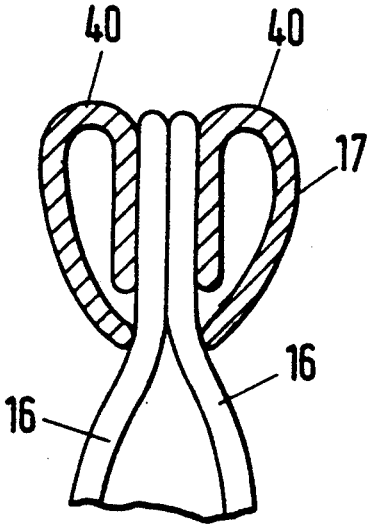

Other appropriate embodiments of the longitudinal reinforcement 17 are shown by way of example in FIGS. 4 to 7. FIG. 4 shows a steel section 35 welded on both sides to the half-shells 16. FIGS. 5 to 7 show other examples of low-cost sheet steel sections 36, 39, 40 which have plane half-shells in the case of the section 36, slightly curved half-shells in the case of the section 39, and welded half-shells 16 in the case of the two-part section 40.

Figure 9:
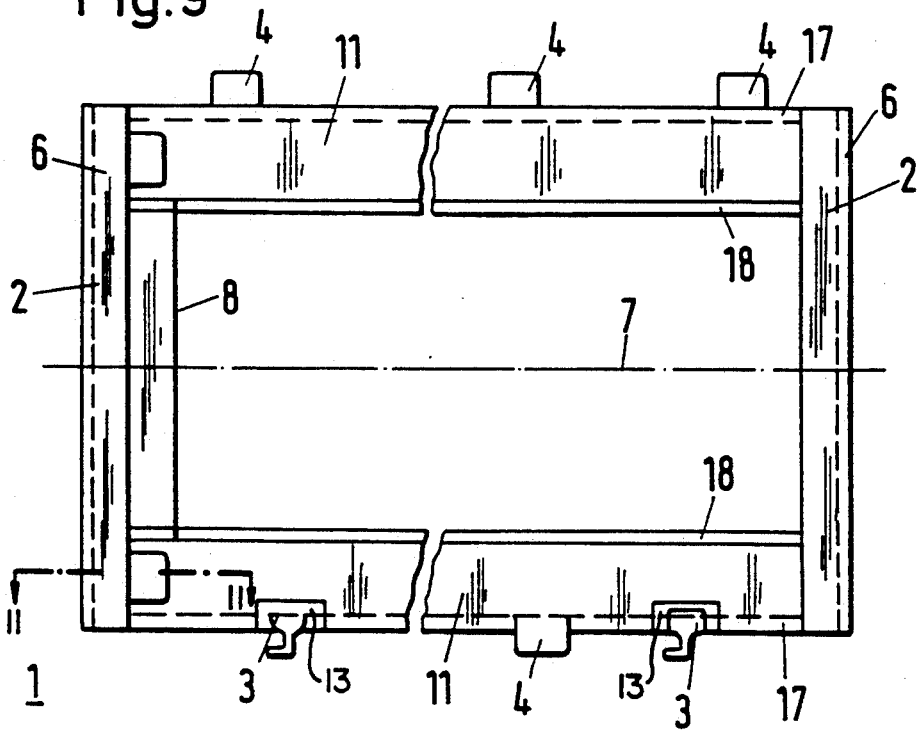
FIG. 9 shows a heald frame constructed according to the invention which has a top and bottom shaft rod.

FIG. 9 shows a heald frame 1 having a top and bottom shaft rod 11 according to the invention. Heald frames having identical shaft rods arranged symmetrically of the frame center 7 are particularly simple to manufacture. The frame has side supports 2 having guide sections 6, actuating elements 3 and top and bottom guide elements 4.

Figure 10:
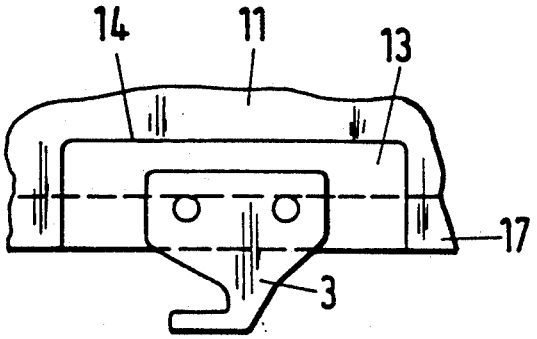
FIG. 10 is a fragmentary view which shows a connecting part with an actuating element.

The partial view of FIG. 10 shows the shape of a connection or transition zone 13 made with a reinforcement sheet welded to the shell and defining bearing surface 14. The actuating element 3 is secured releasably, for example, with screws, or it is secured by bonding (cf. FIG. 6).

Figure 11:
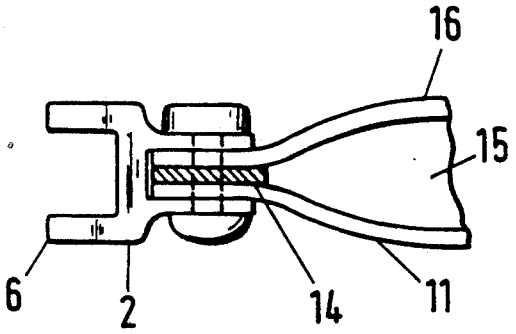
FIG. 11 is a fragmentary view, in section, taken along line 11—11 of FIG. 9 and shows a connection zone leading to the side supports of the heald frame.

FIG. 11 shows a connection of shaft rods 11 to side supports 2. A connection zone 5 (FIG. 3) in the central zone of the rod 11 is formed by a thermoplastics reduction of the half-shells 16 in association with a bearing surface 14 welded in therebetween. The side supports 2 can also be made of a thermoplastics composite material having extra-strong industrial fibers. In this event one side support can be rigidly welded to the shaft rod half-shells while the second side support is connected releasably to enable the healds to be threaded.

What is claimed is:

1. A shaft rod for use on a heald frame of a loom, the shaft rod comprising an elongated, rigid reinforcement member defining an outside of the shaft rod; a carrier bar for supporting heddles spaced from the reinforcement member and defining an inside of the shaft rod; a hollow section disposed between the reinforcement member and the carrier bar constructed of first and second, opposing shell halves having inside and outside surfaces and being constructed of a fiber-reinforced thermoplastic material and means rigidly connecting portions of the shell halves directly to each other; and means rigidly securing the shell halves to the reinforcement member and at least one outside shell surface directly to the carrier bar.

2. A shaft rod according to claim 1 wherein the connecting means includes a weld which rigidly connects the half-shells to each other.

3. A shaft rod according to claim 2 wherein the hollow sections and the carrier bar each define a connecting surface, and wherein the securing means mechanically rigidly secure the carrier bar and the hollow section at said connecting surface.

4. A shaft rod according to claim 3 wherein the connecting surface has a height H oriented perpendicular to a longitudinal extent of the carrier bar and the carrier bar has a thickness D, perpendicular to the connecting surface, and wherein the height H is at least equal to the thickness D.

5. A shaft rod according to claim 1 wherein the carrier bar comprises a steel section.

6. A shaft rod according to claim 5 wherein the carrier bar comprises a sheet steel section.

7. A shaft rod according to claim 1 wherein the reinforcement member comprises a steel section.

8. A shaft rod according to claim 1 wherein the reinforcement member comprises an aluminum section.

9. A shaft rod according to claim 7 wherein the reinforcement member comprises a sheet steel section.

10. A shaft rod according to claim 1 wherein the reinforcement member includes unidirectional reinforcing fibers selected from the group consisting of carbon fibers and glass fibers.

11. A shaft rod according to claim 1 wherein the half-shells include glass fibers comprising at least 50% of the weight of the half-shells.

12. A shaft rod according to claim 11 wherein the half-shells comprise glass fibers oriented at 45° relative to a longitudinal direction of the reinforcement member.

13. A shaft rod according to claim 1 wherein the half-shells comprise a plastic material selected from the group consisting of polyphenylene sulfide, polyether imide, polyamide, polyether sulfon, polysulfone, polyurethane and polyethylene.

14. A shaft rod according to claim 1 wherein the half-shells include edge strips for connection to the reinforcement member and the carrier bar, and wherein at least one of the half-shells includes a flat transition zone between a main portion of the half-shell intermediate the reinforcement member and the carrier bar and at least one of the edge strips, the transition zone being obliquely inclined at an angle W relative to a central plane of the shaft rod.

15. A shaft rod according to claim 14 wherein the angle W is no more than 40°.

16. A shaft rod according to claim 1 including a reinforcing plate secured to a half-shell and defining a connection zone.

17. A shaft rod according to claim 1 including connection zones defined by thermoplastically deformed portions of the half-shells, the zones being disposed along edges of the half-shells extending from the reinforcement member to the carrier bar, and including a lateral support on each side of the half-shells and secured to the connection zones of the half-shells.

18. A substantially flat shaft rod for use on a heald frame of a loom, the shaft rod comprising an elongated, substantially linear, rigid reinforcement member defining an outside of the shaft rod; an elongated carrier bar for supporting heddles spaced from and disposed in a common plane with the reinforcement member and defining an inside of the shaft rod; a hollow section defined by opposing shell halves constructed of a fiber-reinforced thermoplastic material, each shell half defining inner and outer edge strips; and means mechanically rigidly securing portions of the inner edge strips directly to each other and at least one of the outer edge strips directly to the carrier bar, to thereby form a flat, rigid, lightweight shaft rod.

19. A substantially flat shaft rod for use on a heald frame of a loom, the shaft rod comprising an elongated, substantially linear, rigid reinforcement member including a connecting surface and defining an outside of the shaft rod; an elongated carrier bar spaced from and disposed in a common plane with the reinforcement member including a connecting surface and defining an inside of the shaft rod, the carrier bar further including means defining a heddle support extending over substantially the full length of the carrier bar; first and second shell halves each constructed of a fiber-reinforced plastic material, the shell halves being contoured and rigidly connected with each other along overlapping edge strips of the shell halves which are coincident with and overlap the connecting surfaces of the member and the bar so that the shell halves form a hollow section; means rigidly securing the edge strips to the reinforcement member and the carrier bar, respectively; and means connecting to each other shaped portions of the shell halves along connection zones disposed between the reinforcement member and the carrier bar; whereby the shell halves form a rigid, lightweight box member with inner and outer sides rigidified by the reinforcement member and the carrier bar.

20. A shaft rod according to claim 19 wherein the connecting means comprises an elongated, lateral support constructed of thermoplastic, fiber-reinforced material, disposed between and rigidly connected to the shell halves, and extending substantially from the reinforcement member to the carrier bar.

21. A heald frame for a loom, the frame comprising first and second, spaced-apart, flat shaft rods, each shaft rod including an elongated, rigid reinforcement member forming an outer side of the shaft rod, a carrier bar spaced from and disposed in substantially a common plane with the reinforcement member and defining an inner side of the shaft rod, a hollow section defined by opposing shell halves each comprising an inside and outside and surface constructed of a fiber-reinforced plastic material, and means mechanically rigidly connecting portions of the inside surfaces of the shell halves directly to each other and at least one outside shell surface directly to the carrier bar to thereby rigidify the shaft rod; and means connecting the shaft rods to each other so that the reinforcement members of the shaft rods define outer sides of the heald frame.

22. A heald frame according to claim 21 wherein the first and second shaft rods are of identical construction and are arranged symmetrically about a center line of the heald frame which is substantially parallel to the reinforcement member.

23. A heald frame according to claim 21 including connecting elements having relatively large areas placed against corresponding areas of the half-shells and including means mechanically rigidly securing the connecting elements to the half-shells.

24. A heald frame according to claim 21 wherein the means securing the shaft rods to each other comprise lateral supports.

25. A heald frame according to claim 24 wherein the lateral supports are constructed of fiber-reinforced plastic material.

26. A heald frame according to claim 25 including means mechanically rigidly securing the lateral supports to the hollow sections of the shaft rods.

* * * * *